US005133722A

United States Patent [19]

Avrahami et al.

[11] Patent Number: 5,133,722

[45] Date of Patent: Jul. 28, 1992

[54] METHOD AND DEVICE FOR PLUCKING HAIR

[75] Inventors: Zohar Avrahami, Rehovoth; Joseph Gross, Moshav Mazor; Shlomo Zucker, Yavne, all of Israel

[73] Assignees: Elecsys Ltd; Product Development (SGZ) Ltd, both of Petach Tiqua, Israel

[21] Appl. No.: 555,880

[22] Filed: Jul. 23, 1990

[51] Int. Cl.[5] ..... A45D 26/00

[52] U.S. Cl. ..... 606/133; 606/131; 606/1

[58] Field of Search ..... 606/36, 43, 44, 131, 606/133, 210, 211

[56] References Cited

U.S. PATENT DOCUMENTS

| | | | |
|---|---|---|---|
| 2,082,263 | 6/1937 | Schleimer | 606/133 |
| 2,123,870 | 7/1938 | Wehmer | 606/133 |
| 2,592,484 | 4/1952 | Smith | 606/210 |
| 3,613,690 | 10/1971 | Newell | 606/133 |

*Primary Examiner*—Stephen C. Pellegrino
*Assistant Examiner*—Glenn K. Dawson
*Attorney, Agent, or Firm*—Benjamin J. Barish

[57] ABSTRACT

A method and device for plucking hair by engaging the hair with a hair-plucker body to clamp the hair thereto, moving the hair-plucker body and the hair clamp thereto in the plucking direction with respect to the skin, and successively interrupting the movement of the hair-plucker body and the hair clamp thereto such that the hair-plucker body applies a series of short tugs to the hair until it is plucked from the skin.

22 Claims, 5 Drawing Sheets

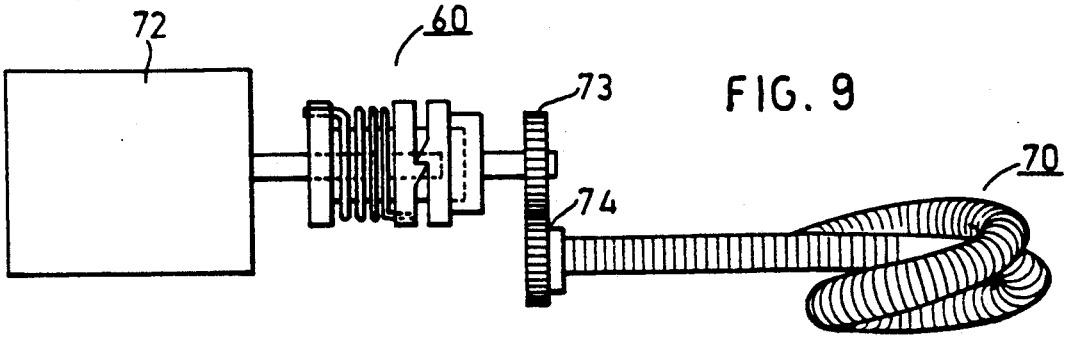
FIG. 9
FIG. 10
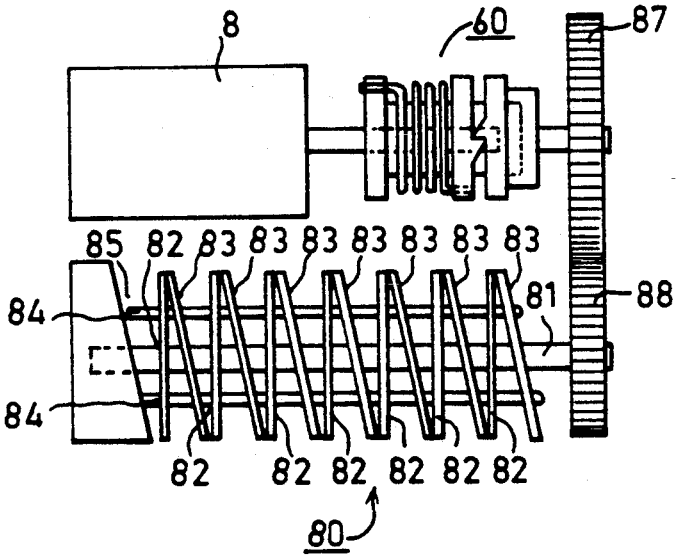
FIG. 11
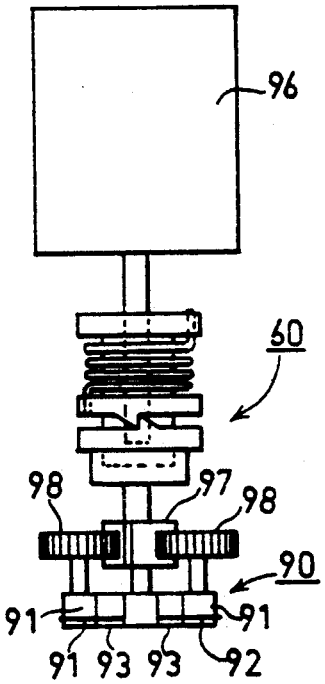
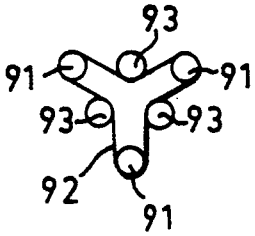
FIG. 11a

METHOD AND DEVICE FOR PLUCKING HAIR

FIELD AND BACKGROUND OF THE INVENTION

The present invention relates to the field of depilation, and more particularly to a method and device for removing hair by plucking it from the skin.

For permanent hair removal, an electrolysis technique is generally used since the electrical current applied to the hair actually kills the hair root and prevents the hair from regrowing. However, electrolysis techniques are slow, painful and expensive. A number of depilatory devices have been developed and are now in use for removing the hair by physcally plucking it from the skin; but in the known devices the root is not completely removed with the plucked hair, and therefore a new hair tends to grow back. Another drawback in the latter devices is that many women find them very painful.

OBJECTS AND BRIEF SUMMARY OF THE INVENTION

An object of the present invention is to provide a method, and also a device, for depilation having advantages in one or both of the above respects.

According to the present invention, there is provided a method of plucking hair from a person's skin, comprising:, engaging the hair with a hair-plucker body to firmly clamp the hair thereto; moving the hair-plucker body, and the hair clamped thereto, away from the skin to pluck the hair therefrom; and successively interrupting the movement of the hair-plucker body and the hair while clamped thereto such that the hair-plucker body applies a series of short tugs to the hair until it is plucked from the skin.

A number of embodiments of the invention are described below for purposes of example. In some embodiments, the hair-plucker body is moved bidirectionally away from and towards the skin between interruptions until the hair is plucked from the skin; and in other described embodiments, it is moved unidirectionally away from the skin between interruptions until the hair is plucked from the skin. In some described embodiments, the hair-plucker body is moved by a reciprocatory electric motor, and in other described embodiments, it is moved by a rotary electric motor and an eccentric coupling between it and the hair-plucker body.

According to further features in some described embodiments, the hair-plucker body is coupled to a tension sensor for measuring the tension applied thereby to the hair, which tension sensor actuates a drive motor for moving the hair-plucker body.

We have found that the foregoing method for plucking hair more completely removes the root with the plucked hair, so that there is substantially less hair regrowth after the hairs have been plucked. We have also found that in many cases the pain associated with the removal of the hair is substantially less than many of the other known hair-plucking type of depilatory devices.

Further features and advantages of the invention will be apparent from the description below.

BRIEF DESCRIPTION OF THE DRAWINGS

The invention is herein described, by way of example only, with reference to the accompanying drawings, wherein:

FIGS. 9–11 illustrate three other types of depilatory devices constructed in accordance with the present invention, FIG. 11*a* being an end view of the device of FIG. 11.

DESCRIPTION OF PREFERRED EMBODIMENTS

Figure 1:
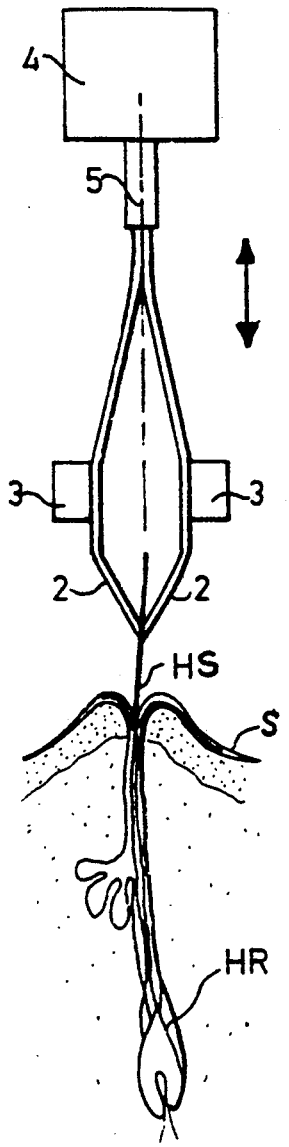
FIG. 1 illustrates the manner of plucking a single hair follicle in accordance with the invention of the present application.

Reference is first made to FIG. 1, illustrating one form of device for plucking hair in accordance with the present invention. The hair to be plucked includes a hair shaft HS growing out of the skin S and a hair root HR within the skin. The illustrated device comprises a pair of tweezers 2 which are manually closed by the user by pressing against fingerpieces 3 to clamp the hair shaft HS. The tweezers 2 are driven by a motor 4 in the direction away from the skin while the tweezers 2 clamp the hair. Motor 4 successively interrupts the movement of the tweezers 2, and the hair clamped thereto, such that the tweezers apply a series of short tugs to the hair until it is plucked from the skin.

It has been found that this method of plucking hair tends to more completely remove the hair root HR with the hair shaft HS and therefore there is less liklihood that the hair will grow back. It has also been found that, in many cases, the pain experienced by the user in removing the hair according to this technique is substantially less than other hair-plucking techniques.

Motor 4 may be a reciprocatory type motor, in which case it moves the tweezers 2 bidirectionally (towards and away from the skin S) after each interruption. On the other hand, motor 4 may also be an intermittent motor, such as a stepping motor, in which case it would move the tweezers 2 unidirectionally after each interruption. Generally speaking, the movements of the tweezers 2 should be at a frequency of about 10–200 interruptions per second, and at a displacement of about 0.1–3.0 mm between interruptions.

The device illustrated in FIG. 1 further includes a tension sensor 5 which senses the tension applied by the tweezers 2 when pulling the hair shaft HS. Tension sensor 5 may thus be used for controlling the electric motor 4 to energize it only when tension is applied by the tweezers 2 to the hair shaft HS.

Figure 2:
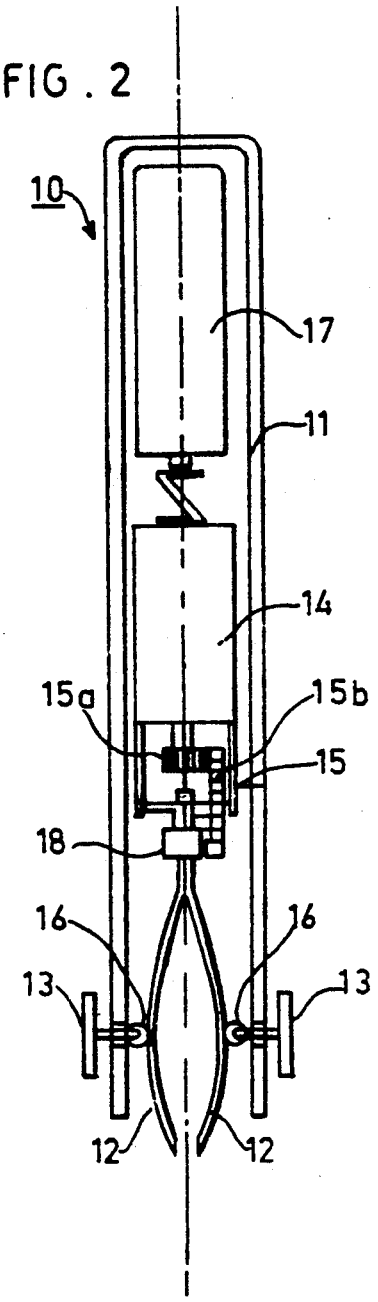
FIG. 2 more particularly illustrates one form of apparatus that may be used in plucking hair in accordance with the method of FIG. 1, FIG. 2*a* being a side elevational view of a portion of the apparatus of FIG. 2.
Figure 2A:
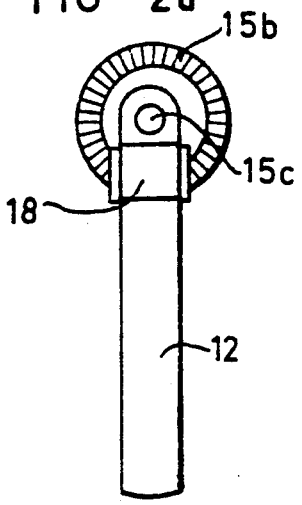

FIGS. 2 and 2*a* illustrate another device, generally designated 10, includes a frame or housing 11 enclosing a pair of tweezers 12 for plucking the hair and movable by a pair of fingerpieces 13 to clamp the hair between the tweezers. The tweezers 12, while clamped to the hair to be removed, are driven by an electric motor 14 bidirectionally, towards and away from the skin, in order to apply the series of short tugs to the hair until it is plucked from the skin.

In the construction illustrated in FIGS. 2 and 2*a*, however, the reciprocatory movements of the tweezers 12 are effected by an eccentric mechanism, generally designatd 15, between the electric motor 14 and the tweezers 12. Thus, the eccentric mechanism 15 includes a gear 15*a* coupled to the rotary shaft of motor 14, meshing with another gear 15*b* coupled, via an eccentric coupling 15*c* (FIG. 2*a*) to the pair of tweezers 12, so that the energization of motor 14 will move the tweezers 12, and the hair clamped by them, towards and away from the skin as the device as a whole is moved by the user away from the skin. The fingerpieces 13 project through the frame or housing 11 and terminate in rollers 16 engageable with the tweezers 12, to enable the tweezers 12 to be reciprocated by motor 14 when the tweezers are closed to their clamping position by pressing the fingerpieces 13.

The device illustrated in FIG. 2 further includes a battery 17 for energizing the electric motor 14. It may also include a tension sensor 18, corresponding to sensor 5 in FIG. 1.

Figure 3:
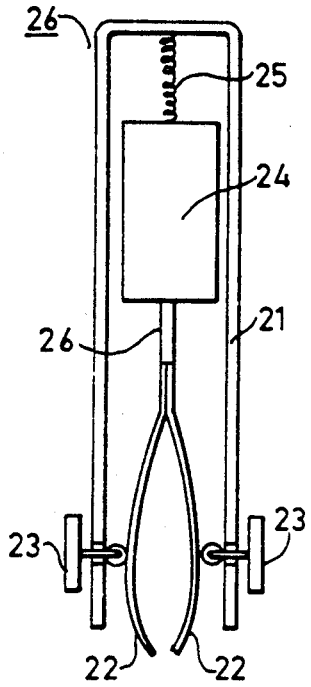
FIGS. 3 and 4 illustrate variations in the apparatus of FIGS. 1 and 2.

FIG. 3 illustrates a device, generally designated 20, similar to device 10 of FIG. 2, in that it includes a frame or housing 21 having a pair of tweezers 22 projecting through one end and closable by fingerpieces 23 during the reciprocation of the tweezers by reciprocatory motor 24, which may of the type described in FIG. 2, namely including a rotary motor and an eccentric drive. In this case, motor 24 is spring-mounted by spring 25 to the housing or frame 21, and preferably also includes a tension sensor 26 for sensing the tension during the plucking operation so as to turn-on the motor only when the tweezers 22, carried by the motor 24, are in clamping engagement with the hair to be plucked and apply tension thereto by the movement of the housing 21 with respect to the user's skin. The spring 25 suspension of the motor and tweezers avoids accidentially transmitting high forces to the hair by sharp movements of the housing 21 held by the user.

Figure 4:
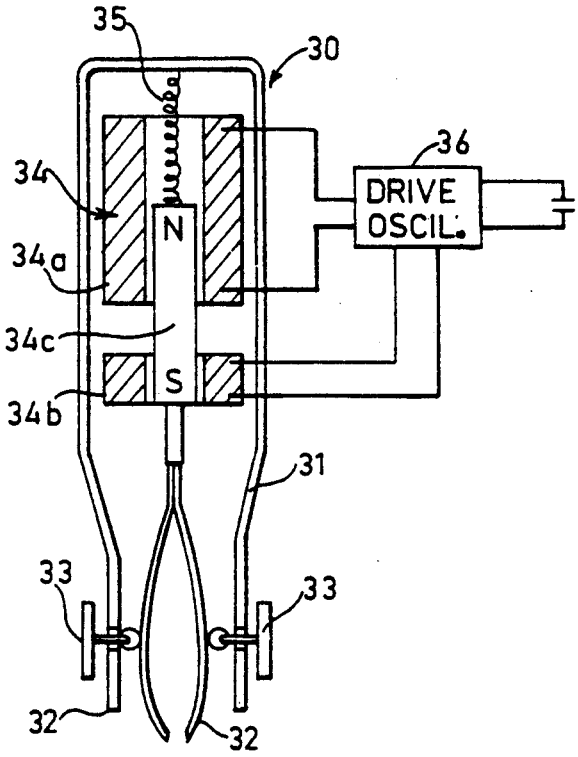

FIG. 4 illustrates a device, generally designated 30, similar to that of FIG. 3, also including a housing or frame 31, a pair of tweezers 32 projecting from the open end, and fingerpieces 33 for pressing the tweezers together to clamp onto the hair to be plucked. In this case, the receiprocatory motor, therein designated 34, comprises a solenoid including a pair of coils 34*a*, 34*b* fixed to the housing 31, and a core 34*c* mounted to the housing by a spring 35. Current through coil 34*a* is controlled by a drive oscillator circuit 36 to apply reciprocatory movements to the core 34*c*, and thereby to the tweezers 32. Coil 34*b* is used as a tension sensor. It senses the tension applied to the hair clamped by tweezers 32, and upon displacement of core 34*c*, it induces a voltage pulse to actuate the drive oscillator 36 when the hair is under tension.

The devices so far described as illustrated in FIGS. 1–4 are intended for plucking individual hairs, e.g., from the user's face. Now will be described a number of devices that may be used for plucking many hairs at a time, e.g., from the user's legs or arms.

Figure 5:
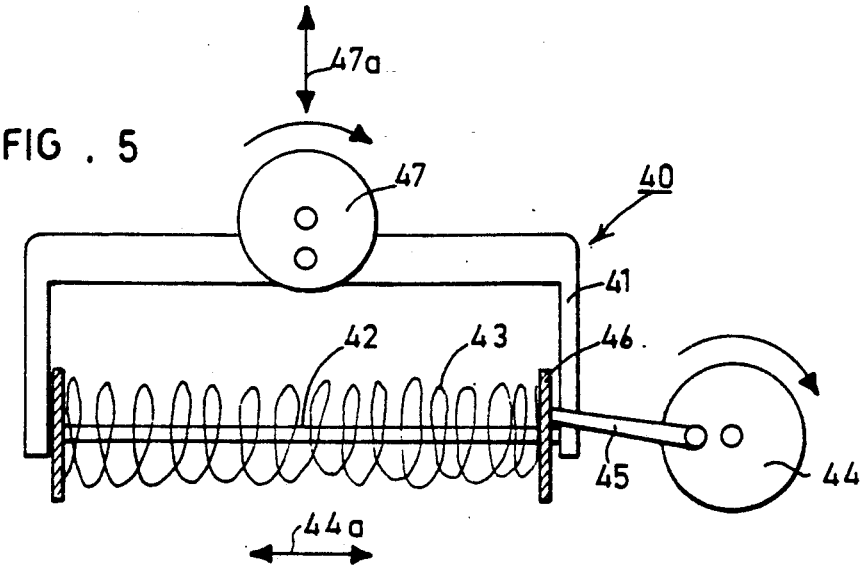
FIGS. 5 and 6 illustrate two other forms of hair-plucker device constructed in accordance with the present invention for plucking a plurality of hairs at one time.

FIG. 5 illustrates one such device, generally designated 40, including a frame 41 fixedly mounting a rod 42, serving as a core for an open helical spring 43. The helical spring is opened and closed, in order to catch the hairs between its coils, by an eccentric drive 44 coupled by a connecting rod 45 to a disc 46 slidably mounted on core 42. Eccentric drive 44 reciprocates disc 46 in the direction of arrow 44*a*, i.e., parallel to the longitudinal axis of core 42.

Another eccentric drive 47 reciprocates the frame 41, and also the core 42, in the direction perpendicular to the longitudinal axis of the core 42, as shown by arrow 47*a*. Thus, eccentric drive 44 moves the coils 43 in the direction shown by arrow 44*a* to open and close the coils and thereby to clamp hairs between them, while eccentric drive 47 reciprocates the frame 41 towards and away from the skin, as shown by arrow 47*a*, to apply the successive tugs to the hairs clamped between the coils until the hairs are plucked.

Figure 6:
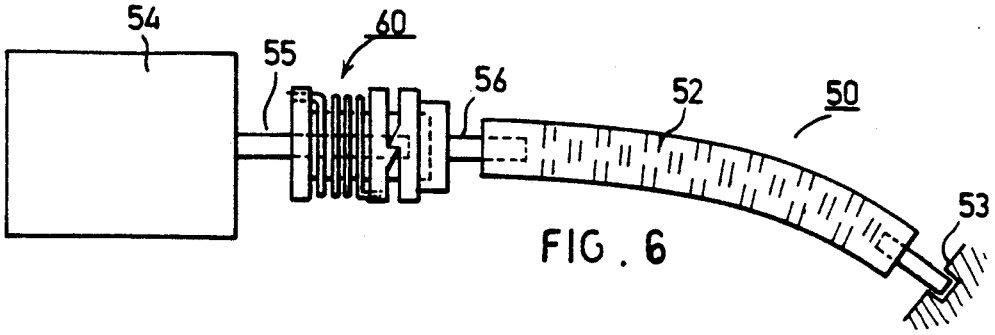

FIG. 6 illustrates the invention incorporated in one form of commercially-available depilatory device, in which the hair-plucker body, therein designated 50, is in the form of an elastomeric rod having a plurality of slits 52 cut on its outer face. Rod 50 is bent into an arc, and one end is received within a bearing 53; the opposite end is coupled to a motor 54 for rotating the rod about its longitudinal axis. Thus, on the convex side of the rod, the slits 52 open to catch the hairs, and on the concave side, they close to clamp the hairs and to pluck them during the rotation of the rod.

In accordance with the present invention, the rotation of the slitted rod 50 is successively interrupted such that the rod applies a series of short tugs to the hair until it is plucked from the skin. For this purpose, the rotary shaft 55 of motor 54 is coupled to shaft 56 of the slitted rod 50 by means of a clutch mechanism, generally designated 60, which successfully couples and decouples the slitted rod from the motor.

Figure 7:
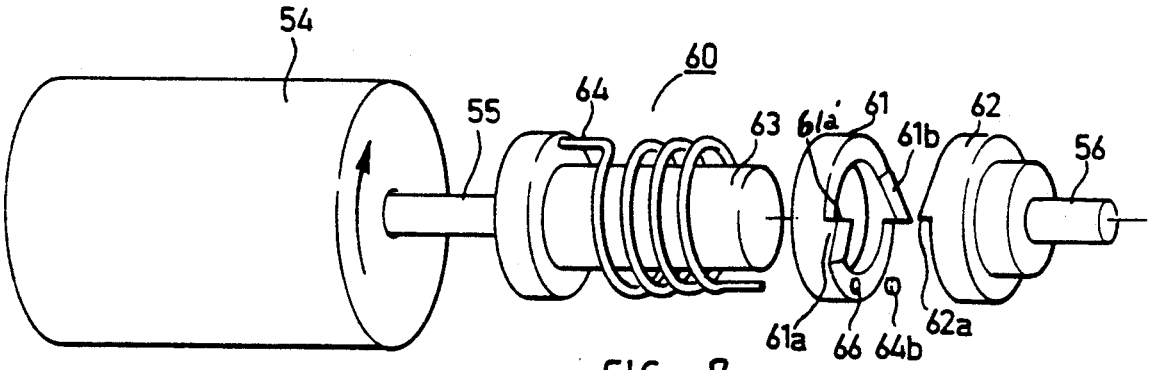
FIG. 7 more particularly illustrtes the clutch in the device of FIG. 6 for successively interrupting the movement of the hair-plucker body and the hair clamped thereto.

Clutch mechanism 60 is more particularly illustrated in FIG. 7. It includes a first clutch plate 61 coupled to the rotary shift 55 by the motor 54, and a second clutch plate 62 coupled to the shaft 56 of the slitted rod 50. The confronting faces of the two clutch plates 61, 62 are formed with two (or more) teeth, as shown at 61*a*, 61*b* for plate 61, and tooth 62*a* (another such tooth not being seen in FIG. 7) for plate 62. Plate 61 is slidably mounted on an extension 63 of the motor rotary shaft 55 and is coupled thereto by a coil spring 64. One end 64*a* of spring 46 is fixed to a disc 65 secured between shaft 55 and its extension 63, and its opposite end 64*b* is fixed within an opening 66 formed in clutch plate 61.

It will be seen that spring 64 normally presses its clutch plate 61 against clutch plate 62 with the perpendicular faces (e.g., face 61*a*') of the teeth 61*a*, 61*b* on clutch plate 61 engaging the perpendicular faces of the corresponding teeth (e.g., 62*a*) on clutch plate 62. Thus, if motor 54 rotates its shaft 55 in the direction of the arrow, the shaft 56 of the slitted rod 50 (FIG. 6) will be rotated in the same direction.

As the slitted rod clamps onto hairs, a load is applied to shaft 56 and is transmitted via the teeth on the two clutch plates 61, 62 to the helical spring 64. This load tends to tighten spring 64, pulling its clutch plate 61 leftwardly out of engagement with clutch plate 62, so that the rotation of the slitted rod 50 is interrupted until the teeth (61*a*, 61*b*) of clutch plate 61 again re-engage the teeth (e.g., 62*a*) of clutch plate 62 to again rotate the slitted rod.

It will thus be seen that while motor 54 continuously rotates, shaft 56 coupled to the slitted rod 50 will not be continuously rotated, but rather will move in successive discrete steps, such that the slitted rod applies a series of short tugs to the hairs until they are plucked from the skin.

As one example, motor 54 may be rotated 6,000 rpm, and spring 64 may be selected to rotate the hair-plucker body 50 at about one-tenth the speed, e.g., about 600 rpm, so that each complete rotation of the slitted rod will be effected in ten discrete steps, each step producing a short tug to each hair until it is plucked.

Figure 8:
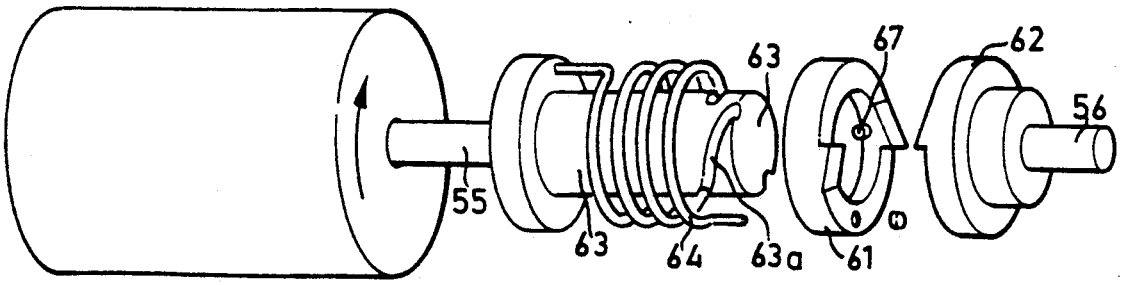
FIG. 8 illustrates a modification in the construction of the clutch of FIG. 7.

FIG. 8 illustrates a modification in the mechanical clutch 60. In this modification, the shaft extension 63 is formed with a helical slot 63*a* at the end receiving the clutch driving clutch disc 61, and the driving clutch disc is formed with a pin 67 received in slot 63*a*. The construction is such that when a load is applied to clutch plate 61, by engagement of the hair-plucker body (the slitted rod 50, FIG. 6) with hairs, shaft exentison 63 will tend to rotate with respect to shaft 56 of the slitted rod 50, whereby pin 67 of clutch plate 61, riding in slot 63*a* of shaft extension 63, will move clutch plate 61 out of engagement with respect to clutch plate 62, thereby decoupling the rotary drive from the slitted rod hair-plucker body 50. In all other respects, the structure and operation of the clutch illustrated in FIG. 8 are substantially the same as described above with respect to FIG. 7.

FIG. 9 illustrates the invention incorporated in another commercial form of depilatory device, namely of the type wherein the hair-plucker body, therein designated 70, is in the form of a closed-coil helical spring supported in an arc (in this case extending for more than 360°) and rotated about its longitudinal axis so that the coils open on the convex side of the helical spring to receive the hairs, and close at the concave side to clamp and pluck the hairs during the rotation of the helical spring. In the construction illustrated in FIG. 9, the motor 72 is coupled to the helical spring hair-plucker body 70 by means of mechanical clutch 60 and gearing 73, 74. Mechanical clutch 60 may be of the construction illustrated in either FIGS. 7 or 8 an is effective to successively interrupt the rotation of the hair-plucker body 70, and the hairs clamped thereto, such that the hair-plucker body applies a series of short tubs to the hair until it is plucked from the skin.

FIG. 10 illustrates the invention corporated in another form of depilatory device commercially available, namely one, generally designated 80, including a plurality of inclined discs rotated about their central axes to engage the hairs between the outer faces of the inclined discs.

More particularly, the hair-plucker body 80 illustrated in FIG. 10 includes a central shaft 81 to which are fixed a plurality of discs 82 substantially perpendicularly to the shaft. Discs 82 alternate with another group of discs 83 which are inclined with respect to discs 82 and are freely movable on shaft 81. All the discs 83 are coupled by rods 84 having one end engageable with a cam 85 which is fixed with respect to the longitudinal axis of shaft 81. The arrangement is such that during the rotation of shaft 81, together with the perpendicular discs 82 and inclined discs 83, rods 84 successively move the inclined discs 83 towards and away from the perpendicular discs 82 to clamp the hairs between the outer faces of the discs.

In this case, the hair-plucker body 80 illustrated in FIG. 10 is coupled to a rotary motor 86, via gearing 87, 88, and a mechanical clutch 60, of the same construction described above with respect to either FIGS. 7 or 8, to successively interrupt the rotation of the hair-plucker body 80 and the hairs clamped thereto, so that the hair-plucker applies a series of short tugs to the hairs until they are plucked from the skin.

FIGS. 11 and 11*a* illustrate the invention applied to a still further form of commercially-available depilatory device, in which the hair-plucker body, generally designated 90, includes a plurality of pulley wheels 91 driving a rubber band 92 between them and a plurality of idler wheels 93. Thus, in this construction, the hairs are caught between the idler wheels 93 and the rubber band 92 and are plucked from the skin during the rotation of the pulley wheels.

As shown in FIG. 11, the hair-plucker body 90 is rotated by an electric motor 96 and gearing 97, 98 via a clutch 60, which may be of the same construction as described above with respect to either FIGS. 6 or 7, to successively interrupt the movement of the hair-plucker body, and the hairs clamped thereto, so that the hair-plucker body applies a series of short tugs to the hairs until they are plucked from the skin.

Figure 12:
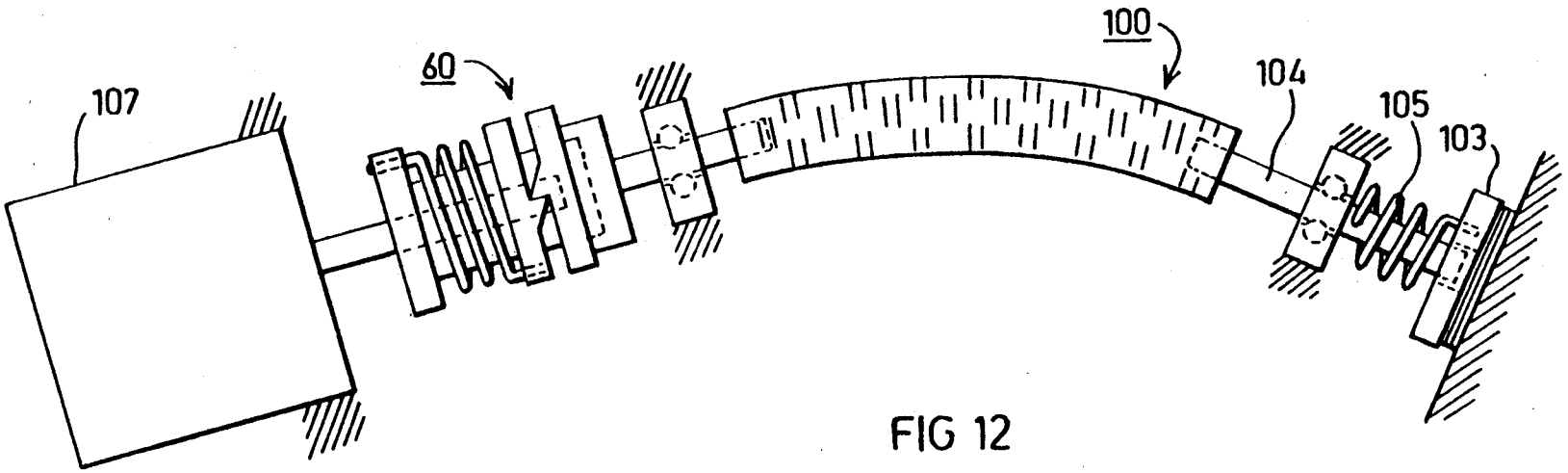
FIG. 12 illustrates a further form of depilatory device constructed in accordance with the present invention.

FIG. 12 illustrates a depilatory device similar to that of FIG. 6, but including an arrangement wherein, during each decoupling of the hair-plucker body, generally designated 100, the hair-plucker body is rotated in the opposite direction as compared to that rotated by the electric motor. For this purpose, the end of the hair-plucker body, therein designated 104, normally received within the bearing (53, FIG. 6), is instead coupled by a spring 105 to a friction disc 103 which frictionally engages a fixed flat source 106. When the hair-plucker body 100 is coupled, via clutch mechanism 60, to the motor 7 and rotates body 100 in one direction, it also loads spring 105. When the hair-plucker body is coupled from the motor, the loaded spring 105 thus rotates the hair-plucker body in the reverse direction, to thereby produce a bidirectional tugging movement to the hair until it is plucked.

Thus, whereas the hair-plucker body 50 illustrated in FIG. 6 (as well as those illustrated in FIGS. 7–11) is always moved unidirectionally, i.e., in the same direction of rotation as their motors, in the construction illustrated in FIG. 12, the hair-plucker body is moved bidirectionally between interruptions, so that with each tug applied by the hair-plucker body to the hair, the hair-plucker body first slightly releases the tension to the hair and then applied the tug.

It will be appreciated that the arrangement illustrated in FIG. 12 may also be used with respect to the depilatory devices illustrated in FIGS. 7–11 as well.

While the invention has been described with respect to several preferred embodiments, it will be apparent that many other variations, modifications and applications of the invention may be made.

What is claimed is:

1. A method of plucking hair from a person's skin, comprising:

engaging the hair with a hair-plucker body to firmly clamp the hair thereto;

moving the hair-plucker body, and the hair clamped thereto, away from the skin to pluck the hair therefrom;

and successively interrupting the movement of the hair-plucker body and the hair while clamped thereto such that the hair-plucker body applies a plurality of short tugs to the clamped hair until it is plucked from the skin.

2. The method according to claim 1, wherein the hair-plucker body is moved bidirectionally, away from and towards the skin, between interruptions until the clamped hair is plucked from the skin.

3. The method according to claim 1, wherein the hair-plucker body is moved unidirectionally, away from the skin, between interruptions until the clamped hair is plucked from the skin.

4. The method according to claim 1, wherein said hair-plucker body is moved by a reciprocatory electric motor.

5. The method according to claim 1, wherein said hair-plucker body is moved by a rotary motor and an eccentric coupling between the rotary motor and the hair-plucker body.

6. The method according to claim 1, wherein said hair-plucker body is coupled to a tension sensor for sensing the tension applied thereby to the hair, which tension sensor actuates a drive motor for moving the hair-plucker body.

7. A device for plucking hair from a person's skin, comprising:

a hair-plucker body for firmly clamping the hair and movable away from the skin until the hair is plucked therefrom;

and a drive for successively interrupting the movement of the hair-plucker body and the hair while clamped thereto at a frequency of about 10–200 interruptions per second, such that the hair-plucker body applies a series of short tugs to the clamped hair until it is plucked from the skin.

8. The device according to claim 7, wherein said drive comprises means for moving the hair-plucker body bidirectionally, away from and toward the skin, between interruptions until the hair is plucked from the skin.

9. The device according to claim 7, wherein said drive comprises means for moving the hair-plucker body unidirectionally, away from the skin, between interruptions until the hair is plucked from the skin.

10. The device according to claim 7, wherein said drive comprises a reciprocatory electric motor.

11. The device according to claim 7, wherein said drive comprises a rotary electric motor and an eccentric coupling between the rotary motor and the hair-plucker body.

12. The device according to claim 7, further including a tension sensor coupled to the hair-plucker body for measuring the tension applied thereby to the hair, and an electrical switch which actuates the drive for moving the hair-plucker body in response to the tension sensed by said sensor.

13. The device according to claim 7, wherein said hair-plucker body includes a pair of tweezers, said drive displacing said tweezers about 0.1–3.0 mm between interruptions.

14. The device according to claim 7, wherein said hair-plucker body includes an open coil spring reciprocated by a first motor on a core to close the coils in order to clamp the hair between coils, said core and coil spring being reciprocated by a second motor to apply the series of short tugs to the hair until it is plucked from the skin.

15. The device according to claim 7, wherein said drive comprises a rotary electric motor coupled to the hair-plucker body by a clutch which is successively engaged and disengaged.

16. The device according to claim 15, wherein the motor has a rotary shaft and said clutch has a first clutch plate coupled by a coil spring to the motor rotary shaft, and a second clutch plate coupled to the hair-plucker body, such that during rotation of the motor rotary shaft, the first clutch plate is moved axially by its spring to successively engage and disengage from the second clutch plate and thereby to successively interrupt the movement of the hair-plucker body during the rotation of the rotary motor.

17. The device according to claim 15, wherein the motor has a rotary shaft and said clutch has a first clutch plate coupled by a coil spring to the motor rotary shaft, and further including a pin received within a helical slot in the rotary motor shaft, and a second clutch plate coupled to the hair-plucker body such that during rotation of the motor rotary shaft, the first clutch plate is moved axially by said pin received in said slot to successively engage and disengage from the second clutch plate and thereby to successively interrupt the movement of the hair-plucker body during the rotation of the rotary motor.

18. The device according to claim 7, wherein said hair-plucker body includes an elastomeric rod formed with a plurality of slits and rotated about its longitudinal axis while bent into an arc to engage the hair between the slits thereof.

19. The device according to claim 7, wherein said hair-plucker body includes a closed coil spring rotated about its longitudinal axis while bent into an arc to engage the hair between the coils thereof.

20. The device according to claim 7, wherein said hair-plucker body includes a plurality of inclined discs, said discs having central axes and outer faces, said discs being rotated about their central axes to engage the hair between the outer faces of the inclined discs.

21. The device according to claim 7, wherein said hair-plucker body includes a plurality of pulley wheels driving a rubber band between them to engage the hair between the rubber band and the pulley wheels.

22. The device according to claim 7, wherein said hair-plucker body is driven by an electric motor in one direction via a clutch which is successively disengaged to interrupt the movement of the hair-plucker body in said one direction, and during each disengagement of the clutch the hair-plucker body is driven in the opposite direction by a spring which is loaded when driven in said one direction by the electric motor.

* * * * *